US008826477B1

(12) United States Patent
Xia et al.

(10) Patent No.: US 8,826,477 B1
(45) Date of Patent: Sep. 9, 2014

(54) AIR MATTRESS AND INFLATABLE PRODUCT

(71) Applicant: Zhejiang Natural Travel Goods Co., Ltd., Zhejiang (CN)

(72) Inventors: Yonghui Xia, Zhejiang (CN); Jigui Xia, Zhejiang (CN); Jinglong Cao, Zhejiang (CN)

(73) Assignee: Zhejiang Natural Travel Goods, Co., Ltd., Zhejiang (CN)

( * ) Notice: Subject to any disclaimer, the term of this patent is extended or adjusted under 35 U.S.C. 154(b) by 0 days.

(21) Appl. No.: 14/161,271

(22) Filed: Jan. 22, 2014

(30) Foreign Application Priority Data

Feb. 25, 2013 (CN) ..... 2013 1 0058204
Apr. 8, 2013 (CN) ..... 2013 1 0118933

(51) Int. Cl.
*A47C 27/08* (2006.01)

(52) U.S. Cl.
CPC ..... *A47C 27/081* (2013.01); *A47C 27/087* (2013.01)
USPC ..... 5/712; 5/706

(58) Field of Classification Search
CPC ..... A47C 27/087
USPC ..... 5/655.3, 682, 706, 711, 712
See application file for complete search history.

(56) References Cited

U.S. PATENT DOCUMENTS 1,610,898 A * 12/1926 Steiner ..... 5/712
2,318,492 A 1/1941 Johnson
2,887,692 A * 5/1959 Gosman ..... 5/655.3
3,667,073 A * 6/1972 Renfroe ..... 5/81.1 R
3,790,975 A * 2/1974 Philipp et al. ..... 5/711
4,167,795 A 9/1979 Lambert, Jr.
7,337,485 B2 * 3/2008 Metzger ..... 5/712
8,402,582 B2 * 3/2013 Xia et al. ..... 5/712

FOREIGN PATENT DOCUMENTS

CN 2917434 Y 7/2007
CN 201032956 Y 3/2008
DE 825877 C 12/1951
WO 98/48134 A1 10/1998

OTHER PUBLICATIONS

International Search Report dated Apr. 24, 2014; 7pgs.

* cited by examiner

*Primary Examiner* — Michael Trettel
(74) *Attorney, Agent, or Firm* — Maier & Maier, PLLC

(57) ABSTRACT

The present invention relates to an air mattress and inflatable product. The air mattress includes top and bottom sheets made of a flexible airtight material, and an airtight inflatable compartment formed at least partially by the top and bottom sheets. The air mattress further includes a plurality of elongated flexible strips positioned within the airtight inflatable compartment, each of the strips including a plurality of first bonding portions, intermediate connecting portions and second bonding portions arranged in order along the length direction of the strips, wherein the first bonding portions are bonded to an inner surface of the top sheet to form first bonding surfaces, the second bonding portions are bonded to an inner surface of the bottom sheet to form second bonding surfaces, and the intermediate connecting portions are positioned between the first bonding portions and the second bonding portions. The present air mattress is not only lightweight and flat but also has a simple structure so as to be suited to automated production, thereby reducing productions costs.

8 Claims, 5 Drawing Sheets

300

AIR MATTRESS AND INFLATABLE PRODUCT

CROSS-REFERENCE TO RELATED APPLICATIONS

This application claims benefit of and priority to Chinese Patent Application for Invention No. 201310058204.6, filed on 25 Feb. 2013, and Chinese Patent Application for Invention No. 201310118933.6, filed on 8 Apr. 2013, both of which are incorporated herein by reference in their entirety.

BACKGROUND OF THE INVENTION

1. Field of the Invention

The present invention relates to an air mattress, and also relates to an inflatable product.

2. Description of Related Art

An air mattress typically includes top and bottom sheets formed of a flexible airtight material, the top and bottom sheets being hermetically bonded to each other, thereby forming a sealed inflatable compartment. When inflated, the sealed inflatable compartment is approximately bed-shaped. Within the sealed inflated compartment are provided intermediate connecting members which connect the top sheet to the bottom sheet.

The former air mattress (referred to as "First Generation" air mattress) includes top and bottom sheets formed of polyvinyl chloride (PVC) material and I-shaped or annular connecting bands which are used to support and reinforce hollow portions of the sealed inflatable compartment. However, the "First Generation" air mattress has the following main drawbacks: (1) the air mattress of this type is heavy and thus has poor portability; (2) PVC material is easy to be pierced and worn out; (3) PVC material is brittle at a low temperature and thus is not cold resistant; (3) the air mattress is not environmentally friendly; (5) the air mattress has a poor flatness owing to linear bonding between the I-shaped or annular connecting bands and the top and bottom sheets; (6) the production of the air mattress involves much labors, and thus the automation degree of production is low.

Chinese Utility Model Patent specification CN201894413U discloses an air mattress (referred to as "Second Generation" air mattress). The air mattress includes top and bottom sheets formed of TPU (Thermoplastic Polyurethane) laminated fabrics, and intermediate connecting units which are connected between the top sheet and the bottom sheet. Each of the intermediate connecting units includes a top band which is bonded to the top sheet, a bottom band which is bonded to the bottom sheet, and segments of rope which are connected between the top band and the bottom band. The disclosed air mattress is lightweigth and flat. However, much labor is needed to connect the top and bottom bands by using the segments of rope during the production process. Thus, the automation degree of production remains low.

Therefore, there is needed an air mattress which is lightweight, has flat surfaces and simple in its structure so as to be easy to be manufactured automatically.

SUMMARY OF THE INVENTION

In one aspect, the present invention provides an air mattress, comprising top and bottom sheets made of a flexible airtight material, and an airtight inflatable compartment formed at least partially by the top and bottom sheets; the air mattress further comprising a plurality of elongated flexible strips positioned within the airtight inflatable compartment, each of the strips including a plurality of first bonding portions, intermediate connecting portions and second bonding portions arranged in order along the length direction of the strips, wherein the first bonding portions are bonded to an inner surface of the top sheet to form first bonding surfaces, the second bonding portions are bonded to an inner surface of the bottom sheet to form second bonding surfaces, and the intermediate connecting portions are positioned between the first bonding portions and the second bonding portions.

Owing to the elongated flexible strips which are arranged in a serpentine manner, the air mattress according to the present invention (referred to as "Third Generation" air mattress) has the following advantages: the air mattress not only requires fewer materials and thus is lightweight, but only has surface bonding between the strips and the sheets, instead of line bonding, thereby resulting in high bonding strength and flat surface of the inflated product; the step of manually connecting the segments of rope is omitted, thereby saving labors; production is highly automated, thereby reducing production costs.

In one preferred example, the intermediate connecting portions may form a plurality of first angles with respect to the first bonding portions and at least one of the first angles is a blunt angle; and the intermediate connecting portions may form a plurality of second angles with respect to the second bonding portions and at least one of the second angles is a blunt angle.

In one preferred example, the intermediate connecting portions may be perpendicular to the first bonding portions and the second bonding portions.

In one preferred example, the length of the first bonding portions may be equal to the length of the second bonding portions.

In one preferred example, the air mattress may further comprise at least one second elongated flexible strip which is aligned with at least one of the elongated flexible strips; the second elongated flexible strip including a plurality of first bonding portions, intermediate connecting portions and second bonding portions arranged in order along the length direction of the strip, the first bonding portions being bonded to the inner surface of the top sheet to form first bonding surfaces, the second bonding portions being bonded to the inner surface of the bottom sheet to form second bonding surfaces, and the intermediate connecting portions being positioned between the first bonding portions and the second bonding portions; at least one of the first bonding portions of the second elongated flexible strip may be positioned between the adjacent first bonding portions of the at least one of the elongated flexible strips, and at least one of the second bonding portions of the second elongated flexible strip being positioned between the adjacent second bonding portions of the at least one of the elongated flexible strips.

In one preferred example, the air mattress may further comprise a side sheet, which is hermetically bonded to the top and bottom sheets to form the airtight inflated compartment.

In one preferred example, the air mattress may further comprise at least one elongated flexible strip arranged within the airtight inflated compartment between opposite wall portions of the side sheet, the at least one elongated flexible strip including a plurality of first bonding portions, intermediate connecting portions and second bonding portions arranged in order along the length direction of the strip, the first bonding portions being bonded to an inner surface of one wall portion of the side sheet to form first bonding surfaces, the second bonding portions being bonded to an inner surface of the other wall portion of the side sheet to form second bonding surfaces, and the intermediate connecting portions being positioned between the first bonding portions and the second bonding portions.

In one preferred example, the elongated flexible strips are made of fabrics which are coated on both sides thereof with Polyurethane (PU) material, fabrics laminated on both sides thereof with a Thermoplastic Polyurethane (TPU) film, or a Thermoplastic Polyurethane (TPU) film.

In one preferred example, the first bonding portions and the second bonding portions may be bonded to the inner surfaces of the top and bottom sheets respectively by a high frequency welding process or a thermal welding process.

In another aspect, the present invention provides an air mattress, comprising top and bottom sheets made of a flexible airtight material, and an airtight inflatable compartment formed at least partially by the top and bottom sheets; the air mattress further comprising a plurality of first and second elongated flexible strips positioned within the airtight inflatable compartment; each of the first elongated flexible strips including a plurality of alternating first and second portions along the length direction thereof, the first portions being bonded to the top sheet and the second portions being not bonded to the top sheet; each of the second elongated flexible strips including a plurality of alternating first and second portions along the length direction thereof, the first portions being bonded to the bottom sheet and the second portions being not bonded to the bottom sheet, wherein the second portions of the first elongated flexible strips include connecting portions connected to the first portions of the first elongated flexible strips adjacent to the connecting portions and bonding portions between the connecting portions; wherein the second portions of the second elongated flexible strips include connecting portions connected to the first portions of the second elongated flexible strips adjacent to the connecting portions and bonding portions between the connecting portions; and wherein the bonding portions of the second portions of the first elongated flexible strips are bonded to the bonding portions of the second portions of the second elongated flexible strips. Since the second portions of the first elongated flexible strips are bonded at least partially to the second portions of the second elongated flexible strips, the segments of rope or other intermediate connecting elements are omitted.

In one preferred example, the length of the second portions of the first elongated flexible strips may be greater than a distance between the adjacent first portions of the first elongated flexible strips, and the length of the second portions of the second elongated flexible strips may be greater than a distance between the adjacent first portions of the second elongated flexible strips.

In one preferred example, the length of the bonding portions of the second portions of the first elongated flexible strips is equal to or less than a distance between the adjacent first portions of the first elongated flexible strips, or the length of the bonding portion of the second portions of the second elongated flexible strips is equal to or less than a distance between the adjacent first portions of the second elongated flexible strips.

In another aspect, an inflatable product, comprising two opposite walls made of a flexible airtight material, and an airtight inflatable compartment formed at least partially by the walls; the inflatable product further comprising at least one elongated flexible strip positioned within the airtight inflatable compartment, the strip including a plurality of first bonding portions, intermediate connecting portions and second bonding portions arranged in order along the length direction of the strip, wherein the first bonding portions are bonded to an inner surface of one wall to form first bonding surfaces, the second bonding portions are bonded to an inner surface of the other wall to form second bonding surfaces, and the intermediate connecting portions are positioned between the first bonding portions and the second bonding portions.

The inflatable product may be an inflatable sofa, an inflatable toy and so on.

BRIEF DESCRIPTION OF THE DRAWINGS

The above and other objects and advantages of the present invention will be more apparent by way of example with reference to the drawings.

DETAILED DESCRIPTION OF THE INVENTION

Figure 1:
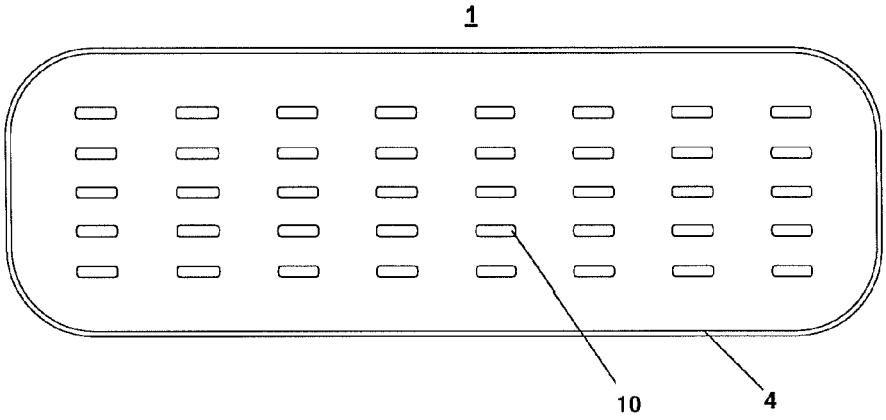
FIG. 1 is a top view of a first example of an air mattress according to the present invention.

The air mattress of the present invention will be described below by way of example with reference to the drawings. However, it is to be understood that the following examples and drawings are illustrative, but not limiting to the scope of the invention. Further, the drawings are not necessarily drawn to scale for purpose of clarity.

Herein, the terms "top" and "bottom" are used merely for the purpose of facilitating the description of the examples shown in the drawings, and not intended for limiting the scope of the invention; the terms "first" and "second" are used merely for the purpose of facilitating the description of the examples shown in the drawings, and not intended for limiting the scope of the invention.

Figure 2:
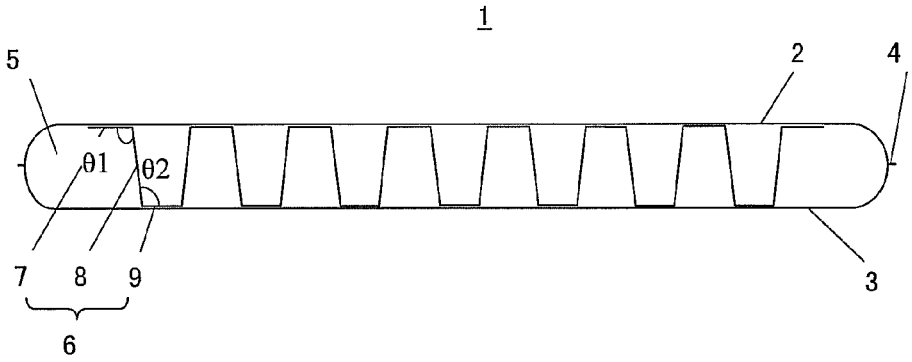
FIG. 2 is a longitudinal sectional view of the air mattress of FIG. 1.
Figure 3:
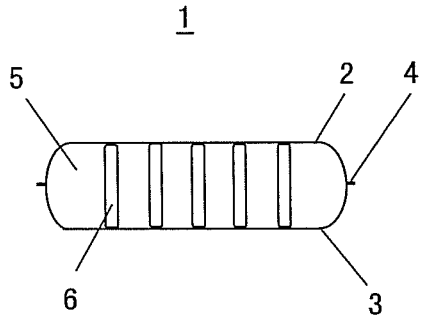
FIG. 3 is a transverse sectional view of the air mattress of FIG. 1.

FIG. 1 is a top view of a first example of an air mattress according to the present invention; FIG. 2 is a longitudinal sectional view of the air mattress of FIG. 1; FIG. 3 is a transverse sectional view of the air mattress of FIG. 1. As shown in FIGS. 2 and 3, an air mattress 1 comprises a top sheet 2 and a bottom sheet 3, which are circumferentially bonded to form a bonding joint 4, thereby forming an airtight inflatable compartment 5. Of course, the air mattress may further comprise a side sheet, in addition to the top sheet and the bottom sheet. Within the inflatable compartment 5 there is provided a plurality of elongated flexible strips 6 (for example, five strips, as shown in FIG. 3), for example which extend in the length direction of the air mattress 1, as shown in FIG. 2. Of course, the elongated flexible strips may extend in the width direction of the air mattress. It will be understood by those skilled in the art that the flexible strips may also extend at an angle to the length or width direction of the air mattress. Herein, the length direction of the air mattress means the direction of an edge which is longer in the horizontal plane when the air mattress is positioned in a horizontal state, and the width direction of the air mattress means the direction which is perpendicular to the length direction in the horizontal plane.

As shown in FIG. 2, each of the elongated flexible strips 6 includes a plurality of first bonding portions 7, intermediate connecting portions 8 and second bonding portions 9 arranged in order along the length direction of the strip. The first bonding portions 7 are bonded to an inner surface of the top sheet 2 to form first bonding surfaces 10, the second bonding portions 9 are bonded to an inner surface of the bottom sheet 3 to form second bonding surfaces (not shown), and the intermediate connecting portions 8 are positioned between the first bonding portions 7 and the second bonding portions 9. The first and second bonding surfaces may be rectangular or elliptic. It will be noted that gaps between the first and second bonding surfaces 7, 9 of the elongated flexible strip 6 and the top and bottom sheet 2, 3 are shown in FIGS. 2 and 3 for the purpose of simplifying the illustration, and in fact, these gaps are not present (the same as other figures). The air mattress 1 may also include means for feeding and discharging air (not shown). When the air mattress is being inflated, the elongated flexible strips 6 restricts the top and bottom sheets 2 and 3 in such a manner that the inflatable compartment 5 looks like a bed that can support the load in an even manner when a user lies on the air mattress. Herein, the term "elongated" means that the length is much greater than the width, for example the length is at least ten times greater than the width, preferably, at least twenty times, more preferably, at least fifty times, most preferably, at least one hundred times.

The top and bottom sheets 2, 3 may be made of a flexible airtight material. Preferably, the flexible airtight material may comprise TPU (Thermoplastic Polyurethane) laminated polyester, TPU laminated nylon, TPU laminated with other fabrics, or other macromolecular material laminated fabrics. The TPU laminated fabrics may include a TPU film of a thickness of from 0.04 to 0.25 mm. The elongated flexible strips 6 may be made of fabrics which are coated on both sides thereof with Polyurethane (PU) material, fabrics laminated on both sides thereof with a TPU film, or a TPU film. Techniques for bonding the top and bottom sheets 2, 3 are not limited, provided that the inflated compartment is airtight. Techniques for bonding the top and bottom sheets 2, 3 on one hand and the top and bottom sheets 2, 3 on the other hand are not limited. For example, a thermal welding process may be used by heating molds and pressing the molds so as to bond them together. Alternatively, a high frequency wave welding process may be used. It is well-know to those skilled in the art that high frequency wave means an electromagnetic wave which has a frequency greater than 100 KHz, and the electromagnetic wave heats the objects by generating intermolecular impacts within the objects, so as to achieve the purpose of welding.

As shown in FIG. 2, the intermediate connecting portions 8 of the elongated flexible strips 6 may form a plurality of first angles θ1 with respect to the first bonding portions 7, and at least one of the first angles θ1 may be a blunt angle; the intermediate connecting portions 8 of the elongated flexible strips 6 may form a plurality of second angles θ2 with respect to the second bonding portions 9, and at least one of the second angles θ may be a blunt angle. Smaller are values of θ1 and θ2, greater macro elasticity the intermediate connecting portions 8 present when the air mattress is compressed. Additionally, in the event that the first and second bonding portions 7, 9 have a certain length, smaller are the values of θ1 and θ2, smaller projections are present on the surface of the air mattress, and more intermediate connecting portions can be arranged in the length or width direction of the air mattress, thereby increasing the shearing stability.

Figure 4:
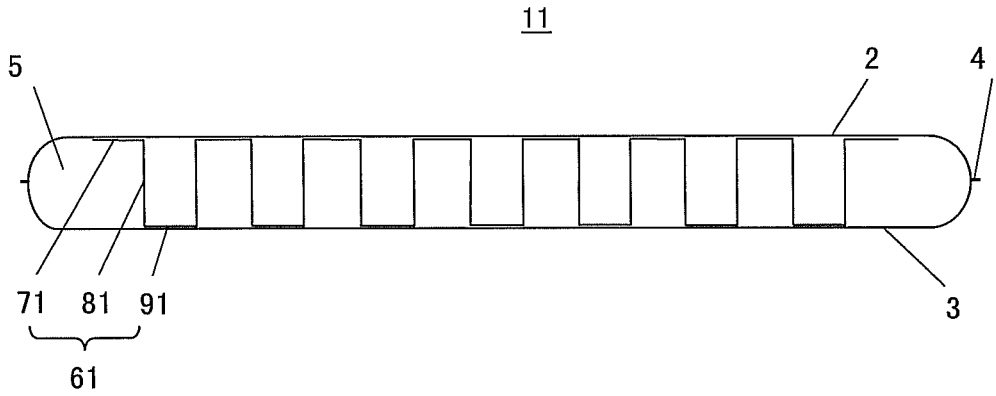
FIG. 4 is a longitudinal sectional view of a variant of the air mattress of FIG. 1.

FIG. 4 is a longitudinal sectional view of a variant of the air mattress of FIG. 1. An air mattress 11 may comprise an elongated flexible strip 61. Intermediate connecting portions 81 of the elongated flexible strip 61 are perpendicular to first bonding portions 71 of the elongated flexible strip 61, and the intermediate connecting portions 81 of the elongated flexible strip 61 are perpendicular to second bonding portions 91 of the elongated flexible strip 61. More preferably, the length of the first bonding portions 71 may be equal to the length of the second boding portions 91.

Figure 5:
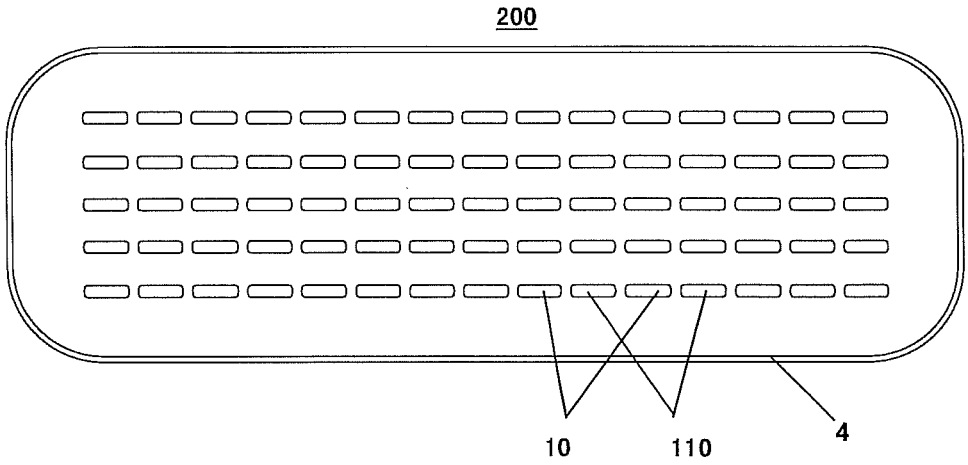
FIG. 5 is a top view of a second example of an air mattress according to the present invention.
Figure 6:
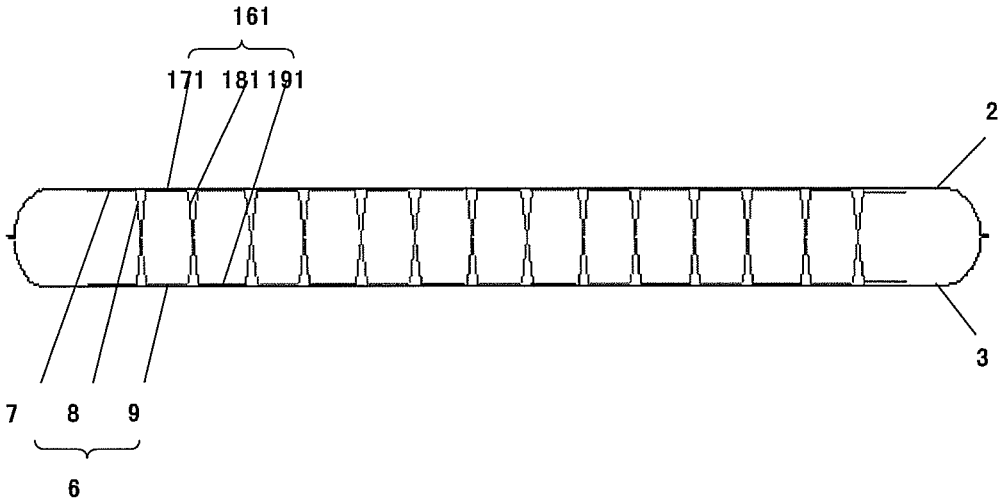
FIG. 6 is a longitudinal sectional view of the air mattress of FIG. 5.

FIG. 5 is a top view of a second example of an air mattress according to the present invention; FIG. 6 is a longitudinal sectional view of the air mattress of FIG. 5. As shown, an air mattress 200 is different from the air mattress 1 of FIG. 1 in that in addition to the elongated flexible strips 6, the air mattress 200 may further comprise at least one second elongated flexible strip 161 which is aligned with at least one of the elongated flexible strips 6. The second elongated flexible strip 161 may include a plurality of first bonding portions 171, intermediate connecting portions 181 and second bonding portions 191 arranged in order along the length direction of the strip. The first bonding portions 171 may be bonded to the inner surface of the top sheet 2 to form first bonding surfaces 110, the second bonding portions 191 may be bonded to the inner surface of the bottom sheet 3 to form second bonding surfaces (not shown), and the intermediate connecting portions 181 may be positioned between the first bonding portions 171 and the second bonding portions 191. At least one of the first bonding portions 171 of the second elongated flexible strip 161 may be positioned between the adjacent first bonding portions 7 of the at least one of the elongated flexible strips 6, and at least one of the second bonding portions 191 of the second elongated flexible strip 161 is positioned between the adjacent second bonding portions 9 of the at least one of the elongated flexible strips 6. Thus, the air mattress contains more bonding areas within the whole surfaces, so that the air mattress has flatter surface.

Figure 7:
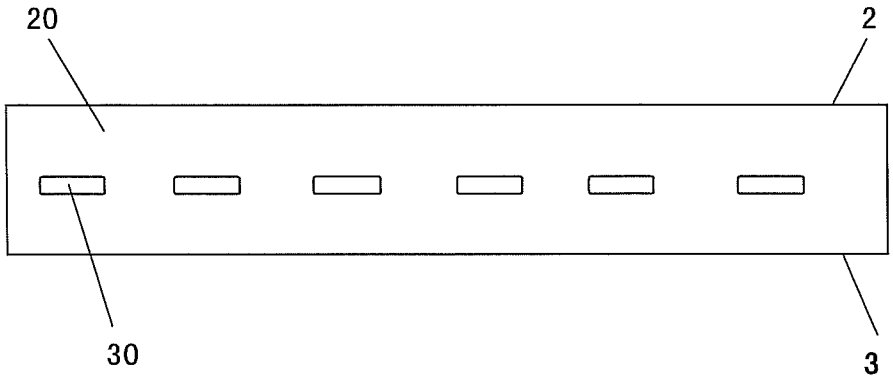
FIG. 7 is a side view of a third example of an air mattress according to the present invention.
Figure 8:
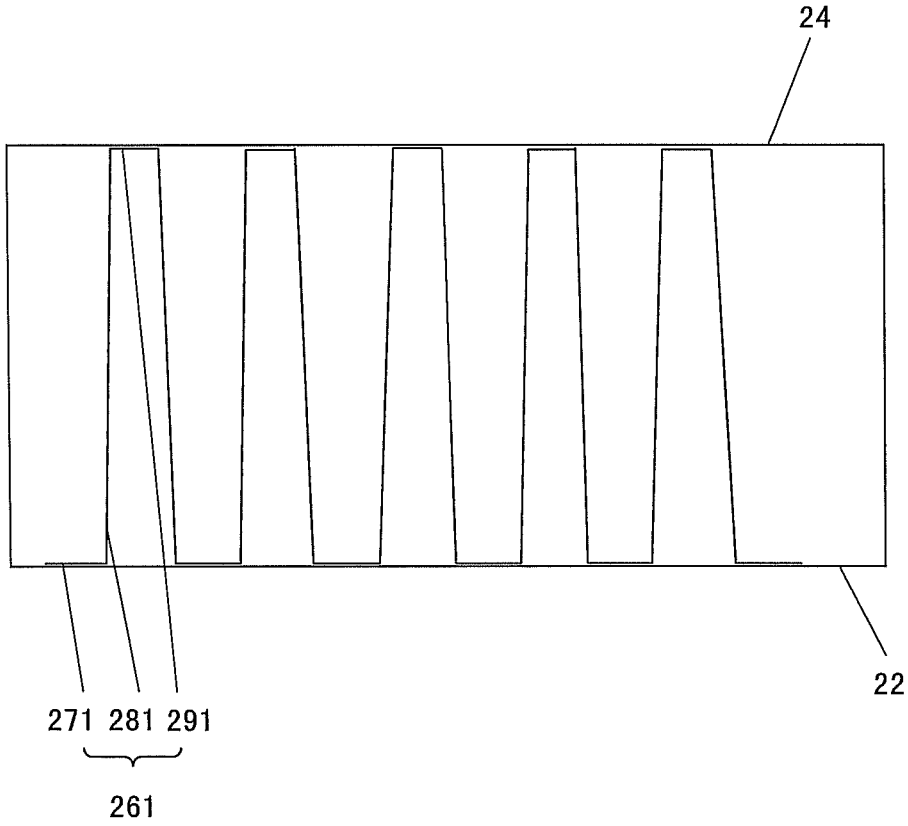
FIG. 8 is a horizontal sectional view of the air mattress of FIG. 7.

FIG. 7 is a side view of a third example of an air mattress according to the present invention; FIG. 8 is a horizontal sectional view of the air mattress of FIG. 7. As shown, an air mattress 300 consists of a top sheet 2, a bottom sheet 3 and a side sheet 20. In addition to the elongated flexible strips (not shown) disposed between the top and bottom sheets, the air mattress 300 may further comprise at least one elongated flexible strip 261 arranged between opposite wall portions 22, 24 of the side sheet 20, the at least one elongated flexible strip 261 including a plurality of first bonding portions 271, intermediate connecting portions 281 and second bonding portions 291 arranged in order along the length direction of the strip. The first bonding portions 271 are bonded to an inner surface of one wall portion 22 of the side sheet 20 to form first bonding surfaces 30, the second bonding portions 291 are bonded to an inner surface of the other wall portion 24 of the side sheet 20 to form second bonding surfaces (not shown), and the intermediate connecting portions 281 are positioned between the first bonding portions 271 and the second bonding portions 291. It will be appreciated by those skilled in the art that in other examples, only at least one elongated flexible strip may be disposed between the opposite wall portions of the side sheet.

It will be appreciated by those skilled in the art that the number of the elongated flexible strips, the length and width of the first and second bonding portions, the length of the intermediate connecting portions, and angles between the intermediate connecting portions and the first and second bonding portions may vary depending on the size of the air mattress and the desired flatness thereof.

Figure 9:
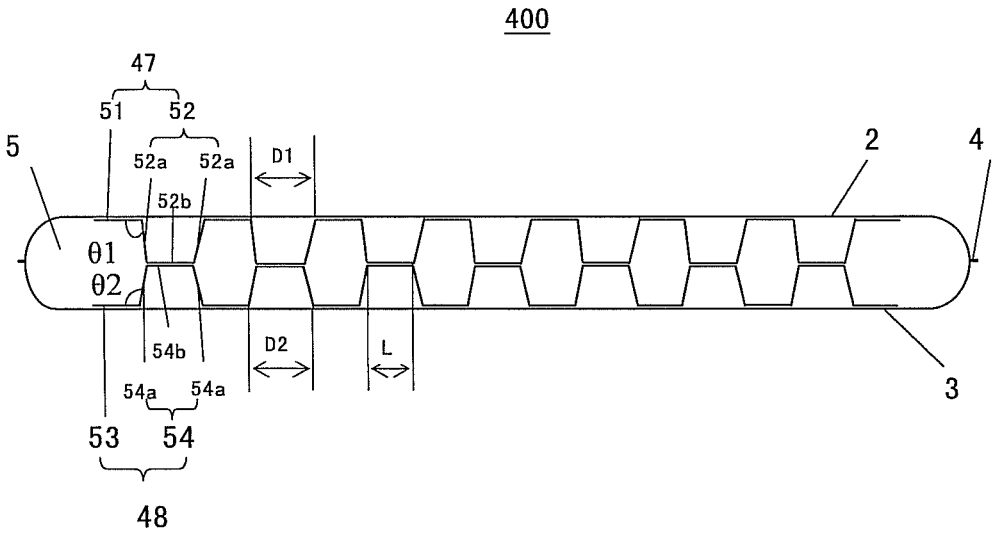
FIG. 9 is a longitudinal sectional view of a fourth example of an air mattress according to the present invention.
Figure 10:
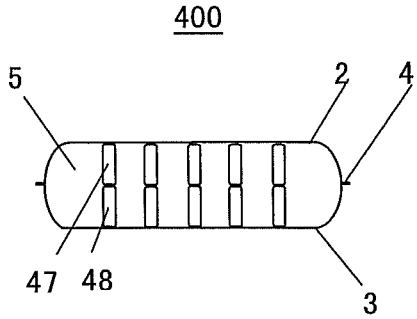
FIG. 10 is a transverse sectional view of the air mattress of FIG. 9.

FIG. 9 is a longitudinal sectional view of a fourth example of an air mattress according to the present invention; FIG. 10 is a transverse sectional view of the air mattress of FIG. 9. As shown in FIGS. 9 and 10, an air mattress comprises a top sheet 2 and a bottom sheet 3, which are circumferentially bonded to form a boding joint 4, thereby forming an airtight inflatable compartment 5. Of course, the air mattress may further comprise a side sheet, in addition to the top sheet and the bottom sheet. The air mattress further comprises a plurality of first and second elongated flexible strips 47, 48 positioned within the airtight inflatable compartment 5. As shown in FIG. 9, each of the first elongated flexible strips 47 includes a plurality of alternating first and second portions 51, 52 along the length direction thereof, the first portions 51 being bonded to the top sheet 2 and the second portions being not bonded to the top sheet 2. Each of the second elongated flexible strips 48 includes a plurality of alternating first and second portions 53, 54 along the length direction thereof, the first portions 53 being bonded to the bottom sheet 3 and the second portions 54 being not bonded to the bottom sheet 3. The first portions 51 of the first elongated flexible strips 47 are bonded to an inner surface of the top sheet 2 to form bonding surfaces (not shown), and the first portions 53 of the second elongated flexible strips 48 are bonded to an inner surface of the bottom sheet 3 to form bonding surfaces (not shown). The bonding surfaces may be rectangular, rhombic or elliptic. The second portions 52 of the first elongated flexible strip 47 are bonded at least partially to the second portions 54 of the second elongated flexible strip 48. For example, as shown, the second portions 52 of the first elongated flexible strips 47 include connecting portions 52*a* connected to the first portions 51 of the first elongated flexible strips 47 adjacent to the connecting portions, and bonding portions 52*b* between the connecting portions 52*a*; the second portions 54 of the second elongated flexible strips 48 include connecting portions 54*a* connected to the first portions 53 of the second elongated flexible strips 48 adjacent to the connecting portions 54*a*, and bonding portions 54*b* between the connecting portions 54*a*. The bonding portions 52*b* of the second portions 52 of the first elongated flexible strips 47 are bonded to the bonding portions 54*b* of the second portions 54 of the second elongated flexible strips 48. The air mattress 400 may also comprise means for feeding and discharging air (not shown). When the air mattress is being inflated, the first and second elongated flexible strips 47, 48 restricts the top and bottom sheets 2, 3 in such a manner that the inflatable compartment 5 looks like a bed that can support the load in an even manner when a user lies on the air mattress. Herein, the term "elongated" means that the length is much greater than the width, for example the length is at least ten times greater than the width, preferably, at least twenty times, more preferably, at least fifty times, most preferably, at least one hundred times.

Since the second portions of the first elongated flexible strips are bonded at least partially to the second portions of the second elongated flexible strips, the segments of rope or other intermediate connecting elements are omitted. Techniques for bonding the boding portions 52*b* of the first elongated flexible strips 47 and the bonding portions 54*b* of the second elongated flexible strips 48 are not limited. For example, an adhesive may be used. Alternatively, a thermal welding process may be used by heating molds and pressing the molds so as to bond them together. Alternatively, a high frequency wave welding process may be used. It is well-know to those skilled in the art that high frequency wave means an electromagnetic wave which has a frequency greater than 100 KHz, and the electromagnetic wave heats the objects by generating intermolecular impacts within the objects, so as to achieve the purpose of welding.

Preferably, the length of the second portions 52 of the first elongated flexible strips 47 is greater than a distance D1 between the adjacent first portions 51 of the first elongated flexible strips 47, and the length of the second portions 54 of the second elongated flexible strips 48 is greater than a distance D2 of the adjacent first portions 53 of the second elongated flexible strips 48. As shown in FIG. 9, the connecting portions 52*a* of the second portions 52 of the first elongated flexible strips 47 may form first angles θ1 with respect to the first portions 51 of the first elongated flexible strips 47, and the first angles θ1 may be blunt angles; the connecting portions 54*a* of the second portions 54 of the second elongated flexible strips 48 may form second angles θ2 with respect to the first portions 53 of the second elongated flexible strips 48, and the second angles θ2 may be blunt angles. The length L of the bonding portions 52*b* of the second portions 52 of the first elongated flexible strips 47 is equal to or less than a distance D1 between the adjacent first portions 51 of the first elongated flexible strips 47, or the length L of the bonding portion 54*b* of the second portions 54 of the second elongated flexible strips 48 is equal to or less than a distance D2 between the adjacent first portions 53 of the second elongated flexible strips 48. Smaller are values of θ1 and θ2, greater macro elasticity the connecting portions 52*a* of the second portions 52 of the first elongated flexible strips 47 and the connecting portions 54*a* of the second portions 54 of the second elongated flexible strips 48 present when the air mattress is compressed.

Although the above description shows that the elongated flexible strips are used in the air mattress, it will be understood by those skilled in the art that the above elongated flexible strips can also be used in other inflatable products, such as an inflatable sofa, an inflatable toy and so on. In the inflatable products, the first bonding portions of the elongated flexible strips are bonded to one wall, and the second bonding portions are bonded to the other opposite wall, thereby serving the function of restricting the shape and supporting the load when the inflatable products are inflated.

The above examples are only illustrative of the present invention, not limiting to the scope of the invention which is defined by the appended claims. Further, it is to be understood that various modification and substitutions are possible without departing from the spirit of the present invention.

What is claimed is:

1. An air mattress, comprising top and bottom sheets made of a flexible airtight material, and an airtight inflatable compartment formed at least partially by the top and bottom sheets;

wherein:

the air mattress further comprises a plurality of elongated flexible strips positioned within the airtight inflatable compartment, each of the strips includes a plurality of first bonding portions, intermediate connecting portions and second bonding portions arranged in order along the length direction of the strips, wherein the first bonding portions are bonded to an inner surface of the top sheet to form first bonding surfaces, the second bonding portions are bonded to an inner surface of the bottom sheet to form second bonding surfaces, and the intermediate connecting portions are positioned between the first bonding portions and the second bonding portions, wherein the intermediate connecting portions are perpendicular to the first bonding portions and the second bonding portions.

2. The air mattress of claim 1, wherein the length of the first bonding portions is equal to the length of the second bonding portions.

3. The air mattress of claim 1, wherein the air mattress further comprises at least one second elongated flexible strip which is aligned with at least one of the elongated flexible strips;

wherein the second elongated flexible strip includes a plurality of first bonding portions, intermediate connecting portions and second bonding portions arranged in order along the length direction of the strip, wherein the first bonding portions are bonded to the inner surface of the top sheet to form first bonding surfaces, the second bonding portions are bonded to the inner surface of the bottom sheet to form second bonding surfaces, and the intermediate connecting portions are positioned between the first bonding portions and the second bonding portions;

wherein at least one of the first bonding portions of the second elongated flexible strip is positioned between the adjacent first bonding portions of the at least one of the elongated flexible strips, and at least one of the second bonding portions of the second elongated flexible strip is positioned between the adjacent second bonding portions of the at least one of the elongated flexible strips.

4. The air mattress of claim 1, wherein the air mattress further comprises a side sheet, which is hermetically bonded to the top and bottom sheets to form the airtight inflated compartment.

5. The air mattress of claim 4, wherein the air mattress further comprises at least one elongated flexible strip arranged within the airtight inflated compartment between opposite wall portions of the side sheet, wherein the at least one elongated flexible strip includes a plurality of first bonding portions, intermediate connecting portions and second bonding portions arranged in order along the length direction of the strip, wherein the first bonding portions are bonded to an inner surface of one wall portion of the side sheet to form first bonding surfaces, the second bonding portions are bonded to an inner surface of the other wall portion of the side sheet to form second bonding surfaces, and the intermediate connecting portions are positioned between the first bonding portions and the second bonding portions.

6. The air mattress of claim 1, wherein the elongated flexible strips are made of fabrics which are coated on both sides thereof with Polyurethane (PU) material, fabrics laminated on both sides thereof with a Thermoplastic Polyurethane (TPU) film, or a Thermoplastic Polyurethane (TPU) film.

7. The air mattress of claim 1, wherein the first bonding portions and the second bonding portions are bonded to the inner surfaces of the top and bottom sheets respectively by a high frequency welding process or a thermal welding process.

8. An inflatable product, comprising two opposite walls made of a flexible airtight material, and an airtight inflatable compartment formed at least partially by the walls;

wherein, the inflatable product further comprises at least one elongated flexible strip positioned within the airtight inflatable compartment, the strip includes a plurality of first bonding portions, intermediate connecting portions and second bonding portions arranged in order along the length direction of the strip, wherein the first bonding portions are bonded to an inner surface of one wall to form first bonding surfaces, the second bonding portions are bonded to an inner surface of the other wall to form second bonding surfaces, and the intermediate connecting portions are positioned between the first bonding portions and the second bonding portions, wherein the intermediate connecting portions are perpendicular to the first bonding portions and the second bonding portions.

* * * * *